US006635002B1

(12) United States Patent
Yeh

(10) Patent No.: US 6,635,002 B1
(45) Date of Patent: Oct. 21, 2003

(54) SEAL CUTTER FOR PLASTIC BAG

(76) Inventor: Yong-Tsang Yeh, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/154,988

(22) Filed: May 21, 2002

(51) Int. Cl.[7] ..... B31B 1/64
(52) U.S. Cl. ..... 493/197; 493/193; 493/195; 493/203; 493/231
(58) Field of Search ..... 493/193, 195–197, 493/203–206, 231

(56) References Cited

U.S. PATENT DOCUMENTS 3,749,393 A * 7/1973 Wolfelsperger et al. .... 493/434
4,663,915 A * 5/1987 Van Erden et al. ..... 53/450
4,881,933 A * 11/1989 Wech ..... 493/225
4,943,167 A * 7/1990 Gelbard ..... 383/8
4,997,504 A * 3/1991 Wood ..... 156/204
5,000,729 A * 3/1991 Yamauchi ..... 493/359
5,080,338 A * 1/1992 Belanger et al. ..... 270/6
5,102,384 A * 4/1992 Ross et al. ..... 493/243
6,004,252 A * 12/1999 Blaser ..... 493/204
6,416,452 B1 * 7/2002 Meyer ..... 493/210

* cited by examiner

*Primary Examiner*—Eugene Kim
*Assistant Examiner*—Hemant M. Desai

(57) ABSTRACT

A seal cutter for a plastic bag includes a folding device, a conveyor device, a point cut-off device, a tension control device, and a coreless winding device. The folding device includes a rectangular guide plate, a triangular guide plate rested on the rectangular guide plate, and an oblique drive rod located above the triangular guide plate. The tension control device includes a fixed roller set, a movable roller set, and a chain set for moving the movable roller set to engage the fixed roller set. The coreless winding device includes a piston rod structure, and a clamping structure.

10 Claims, 17 Drawing Sheets

SEAL CUTTER FOR PLASTIC BAG

BACKGROUND OF THE INVENTION

1. Field of the Invention

The present invention relates to a seal cutter for a plastic bag, and more particularly to a coreless winding point cut-off seal cutter for a plastic bag.

2. Description of the Related Art

A conventional a seal cutter for a scroll of plastic bag in accordance with the prior art comprises a material support rack for supporting the scroll of plastic bag, a folding device, a conveyor device, a point cut-off device, a tension control device, and a coreless winding device. Thus, the plastic bag may be point cut-off, sealed, wound into a scroll, and packaged. The plastic bag is processed by the point cut-off device, so that the plastic bag may form multiple point cut-off positions that may be torn out for use.

SUMMARY OF THE INVENTION

The primary objective of the present invention is to provide a seal cutter for a plastic bag, wherein the plastic bag may be formed with a three-folding-layer shape before the plastic bag is sealed, point cut-off and wound into a scroll, thereby reducing the width of the plastic bag after being wound.

Another objective of the present invention is to provide a seal cutter for a plastic bag, wherein the fixing racks may be adjusted, so as to calibrate the folding position of the plastic bag.

A further objective of the present invention is to provide a seal cutter for a plastic bag, wherein the press plates may be used to press the plastic bag when the point cut-off blade is lifted and lowered, thereby enhancing the point cut-off effect of the point cut-off blade.

In accordance with the present invention, there is provided a seal cutter for a plastic bag, comprising a folding device, a conveyor device, a point cut-off device, a tension control device, and a coreless winding device, wherein:

the folding device includes a fixing seat including two opposite fixing racks which are combined with each other by a fixing plate and a roller, a first connecting plate is secured on a bottom of the fixing plate, a rectangular guide plate is mounted on the first connecting plate in an inclined manner, and is provided with a protruding block secured on the first connecting plate, a triangular guide plate is provided with a link secured on one of the two opposite fixing racks, so that the triangular guide plate is rested on the rectangular guide plate, a second connecting plate is secured on the other one of the two opposite fixing racks, a fixing rod is secured on a bottom of the second connecting plate, an oblique drive rod is secured on one end of the fixing rod, and is located above the triangular guide plate;

the conveyor device includes two opposite U-shaped seats for securing a drive rubber wheel, two opposite first slide blocks for securing a driven rubber wheel, two opposite second slide blocks for securing an eccentric shaft, two cover plates for securing the first and second slide blocks on the U-shaped seat, and two adjusting knobs each extended through a respective cover plate to adjust a tension between the first and second slide blocks;

the point cut-off device includes a blade seat, a point cut-off blade, and two press plates, the blade seat has a bottom end formed with multiple spring support seats, and has a top end formed with multiple screw bores, the point cut-off blade is formed with multiple slots aligning with the multiple spring support seats of the blade seat for mounting multiple springs, each of the springs has a top urged on a respective spring support seat of the blade seat and has a bottom urged on the two press plates, the point cut-off blade is formed with multiple step portions, each of the two press plates is mounted on the point cut-off blade by multiple screws which extend through the two press plates and through multiple sleeves between the two press plates, each of the multiple sleeves is rested on a respective step portion of the point cut-off blade;

the tension control device includes a fixed roller set, a movable roller set, and a chain set for moving the movable roller set to engage the fixed roller set;

the coreless winding device includes a piston rod structure, and a clamping structure, wherein:

the piston rod structure includes an outer tube, and a gas pressure cylinder mounted on a rear end of the outer tube, the gas pressure cylinder has a front end secured with a bearing disk, the gas pressure cylinder has a gas pressure rod extended into the outer tube through a bearing hole in the bearing disk, and pivotally connected with a first end of a sleeve which has a second end formed with an elongated through hole, an inner tube is mounted in the bearing hole and the outer tube for receiving the gas pressure rod, two opposite piston rods mounted in the inner tube and protruding outward from an elongated through hole formed in the inner tube, one of the two piston rods is fixed, and the other piston rod is movable; and the clamping structure including two shafts each mounted on a support base and each having two ends each provided with a gear, two inverted U-shaped clips each mounted on one of the two shafts, two gas pressure cylinders each pivotally mounted on the support base and each pivotally mounted on the gear of one of the two shafts, and a gas pressure cylinder mounted on a bottom of the support base for lifting the support base, one of the two inverted U-shaped clips is provided with two opposite small gas pressure cylinders each having a gas pressure rod for driving a drive bar pivotally mounted on a side portion to rotate relatively.

Further benefits and advantages of the present invention will become apparent after a careful reading of the detailed description with appropriate reference to the accompanying drawings.

DETAILED DESCRIPTION OF THE INVENTION

Figure 1:
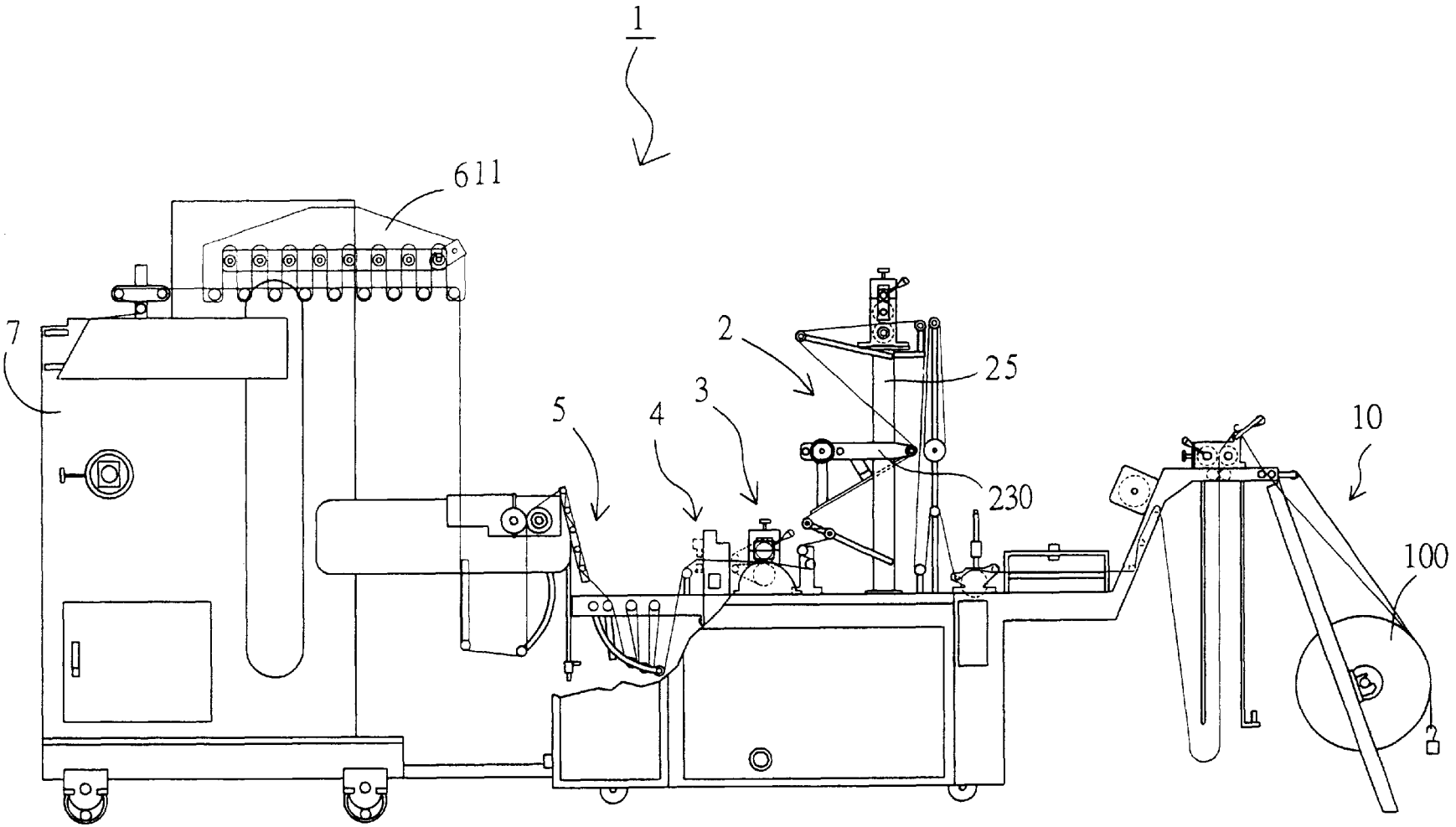
FIG. 1 is a schematic plan view of a seal cutter for a plastic bag in accordance with a preferred embodiment of the present invention.

Referring to the drawings and initially to FIG. 1, a seal cutter 1 for a scroll of plastic bag 100 in accordance with a preferred embodiment of the present invention comprises a material support rack 10 for supporting the scroll of plastic bag 100. The plastic bag 100 is in turn conveyed through a guide rack, a conveyor device 3, and a folding device 2, then conveyed into a point cut-off device 4 to be point cut-off, then guided into a tension bar 5 and a tension control device 61, and finally conveyed to a coreless winding device 7 to be wound and packaged.

Figure 2:
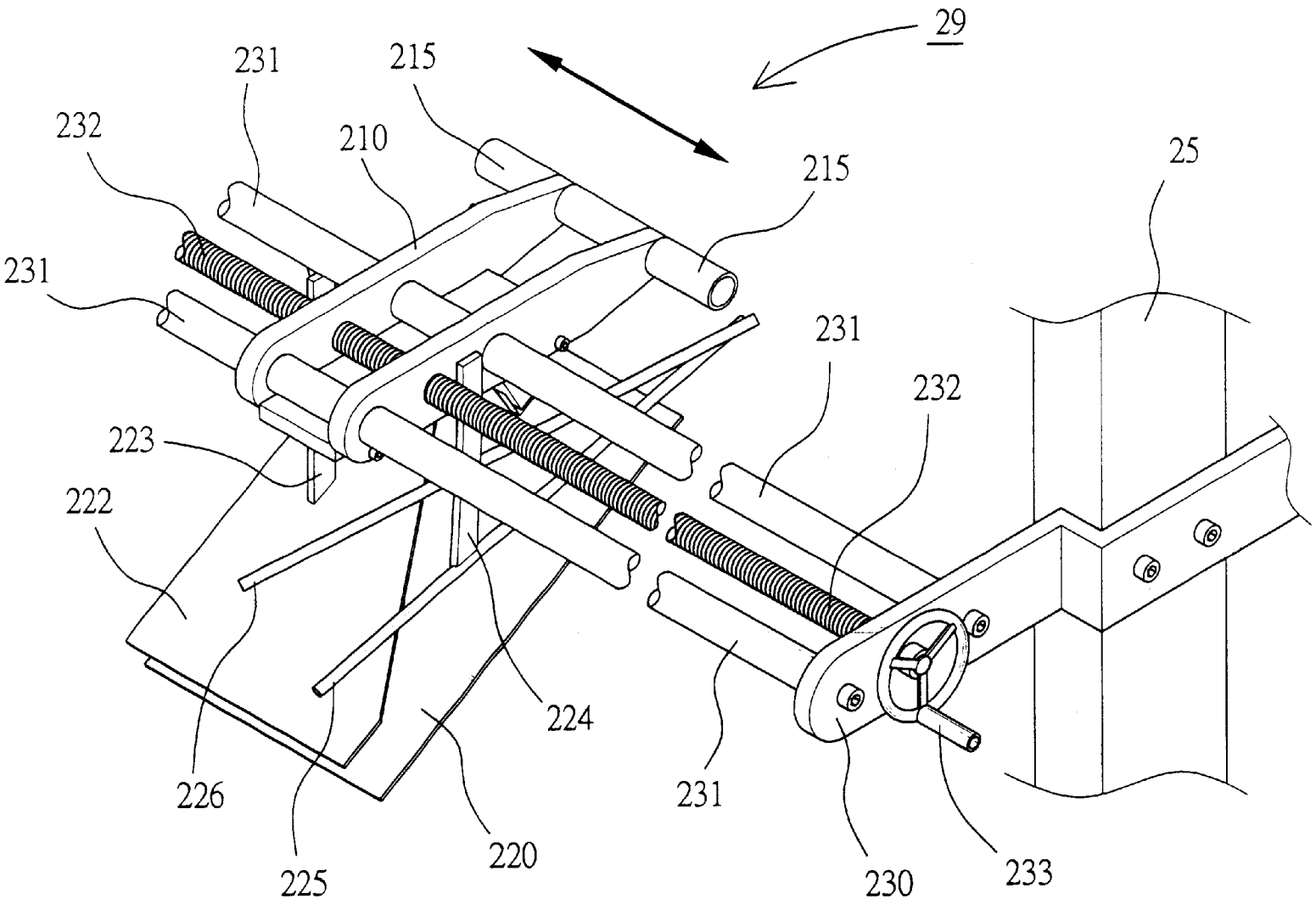
FIG. 2 is a perspective view of a folding device of the seal cutter for a plastic bag in accordance with the preferred embodiment of the present invention.
Figure 3:
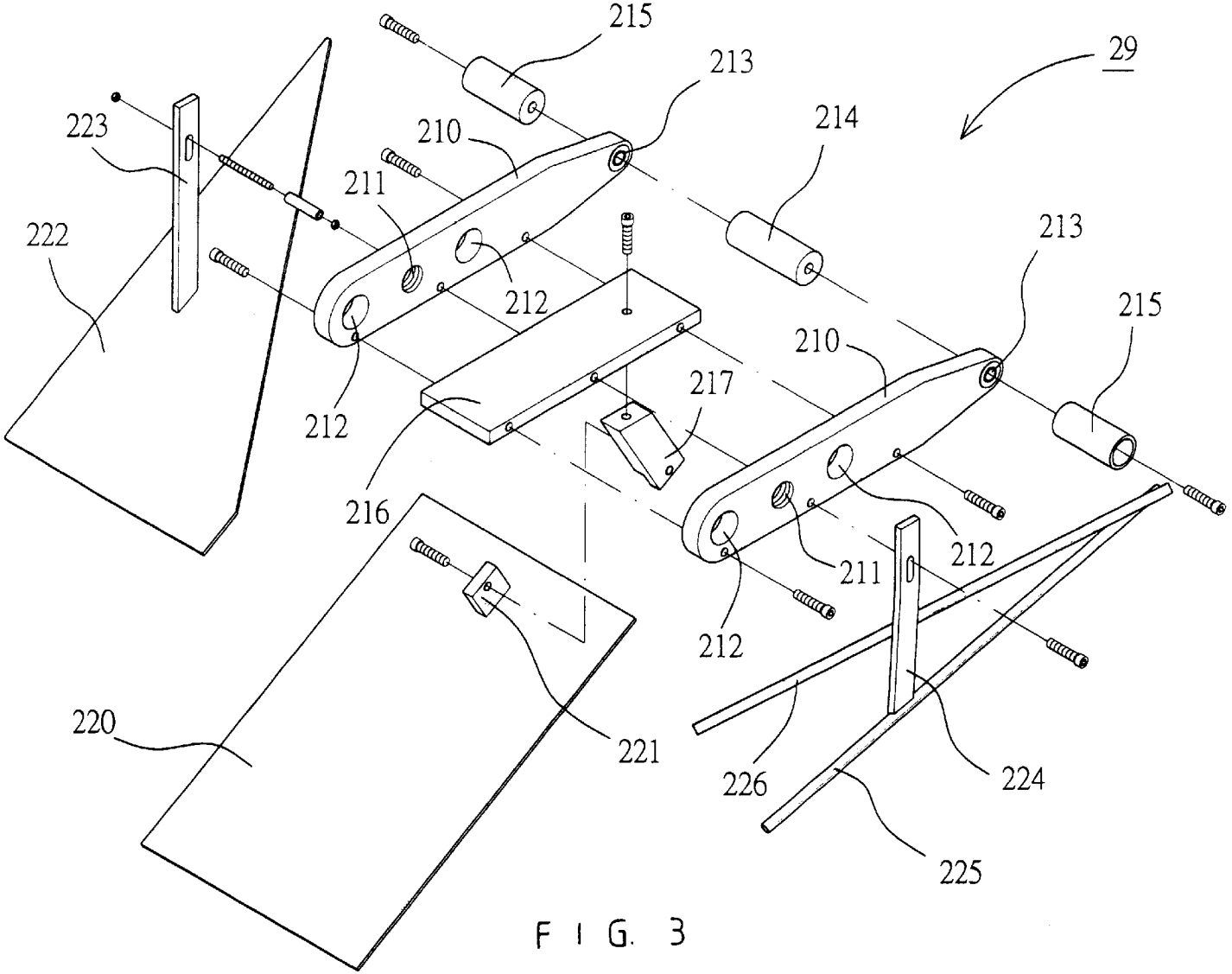
FIG. 3 is a exploded perspective view of the folding device of the seal cutter for a plastic bag as shown in FIG. 2.

Referring to FIGS. 2 and 3, the folding device 2 of the seal cutter 1 includes two opposite upright frames 25, two opposite fixing brackets 230 each secured on one of the two opposite upright frames 25, two opposite slide rods 231 each mounted between the two opposite fixing brackets 230, a threaded rod 232 mounted between the two opposite fixing brackets 230, and a rotation handle 233 mounted on one end of the threaded rod 232 for rotating the threaded rod 232.

In addition, the folding device 2 of the seal cutter 1 further includes a fixing seat 29 including two opposite fixing racks 210 which are combined with each other by a fixing plate 216 and a roller 214. Each of the two opposite fixing racks 210 has one end provided with a bearing 213. Each of the two opposite fixing racks 210 is formed with a screw bore 211 for passage of the threaded rod 232, and two through holes 212 for passage of the two side rods 231. The bearing 213 of each of the two opposite fixing racks 210 is secured with a roller 215. A connecting plate 217 is secured on a bottom of the fixing plate 216. A rectangular guide plate 220 is mounted on the connecting plate 217 in an inclined manner, and is provided with a protruding block 221 secured on the connecting plate 217. A triangular guide plate 222 is provided with a link 223 secured on an outer side of one of the two opposite fixing racks 210, so that the triangular guide plate 222 is rested on the rectangular guide plate 220. A connecting plate 224 is secured on an outer side of the other one of the two opposite fixing racks 210. A fixing rod 225 is secured on a bottom of the connecting plate 224. An oblique drive rod 226 is secured on one end of the fixing rod 225, and is located above the triangular guide plate 222.

Figure 4:
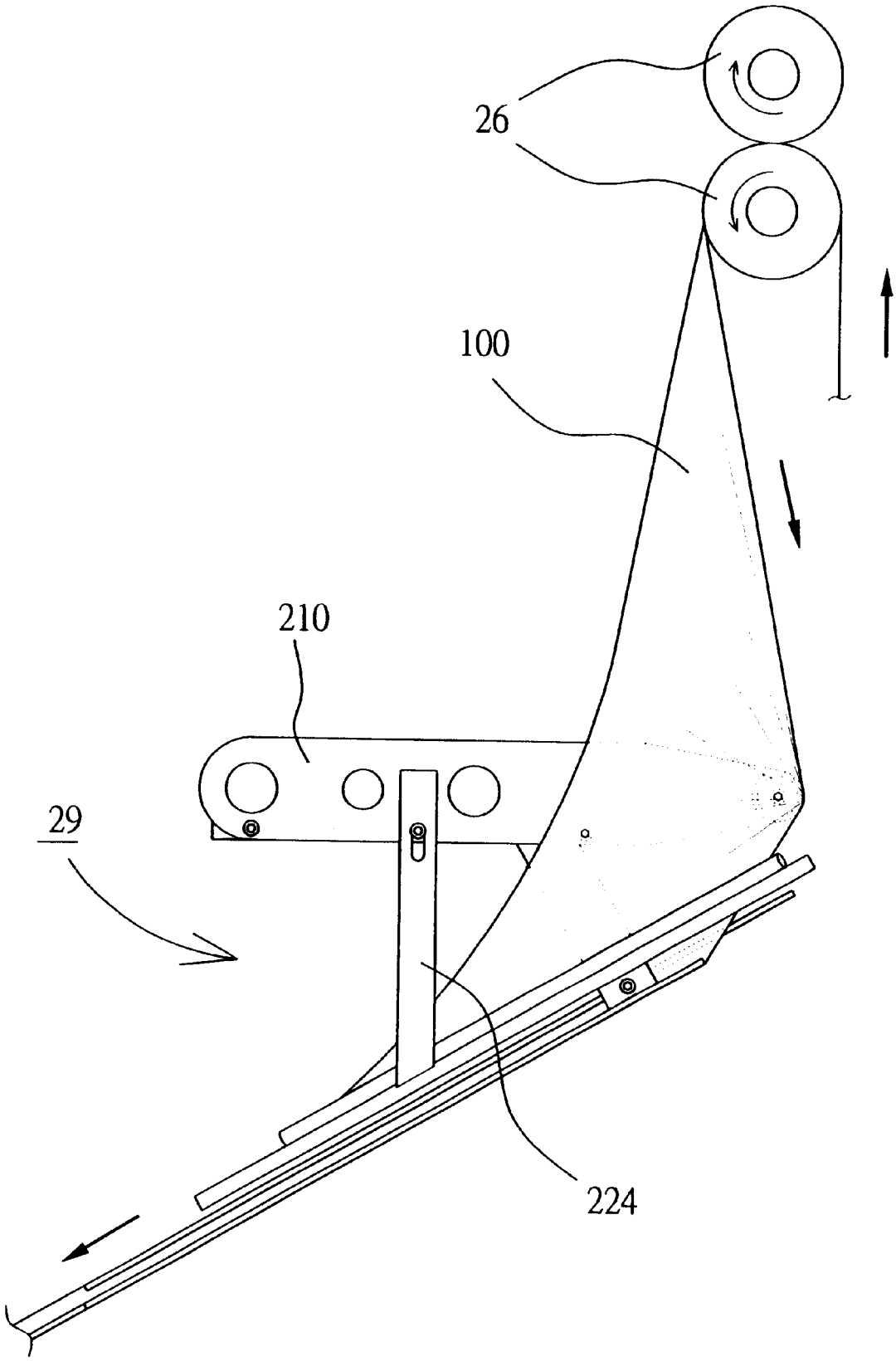
FIG. 4 is a schematic side plan view of the folding device of the seal cutter for a plastic bag as shown in FIG. 2.

Referring to FIG. 4, the plastic bag 100 is conveyed by two conveyor rollers 26 to the fixing seat 29. At this time, the plastic bag 100 has a cylindrical shape. When the plastic bag 100 is passed through the fixing seat 29, the two sides of the plastic bag 100 are turned and folded. Then, the plastic bag 100 is conveyed into the point cut-off device 4 to be point cut-off and wound, thereby achieving the predicted purpose.

Figure 5:
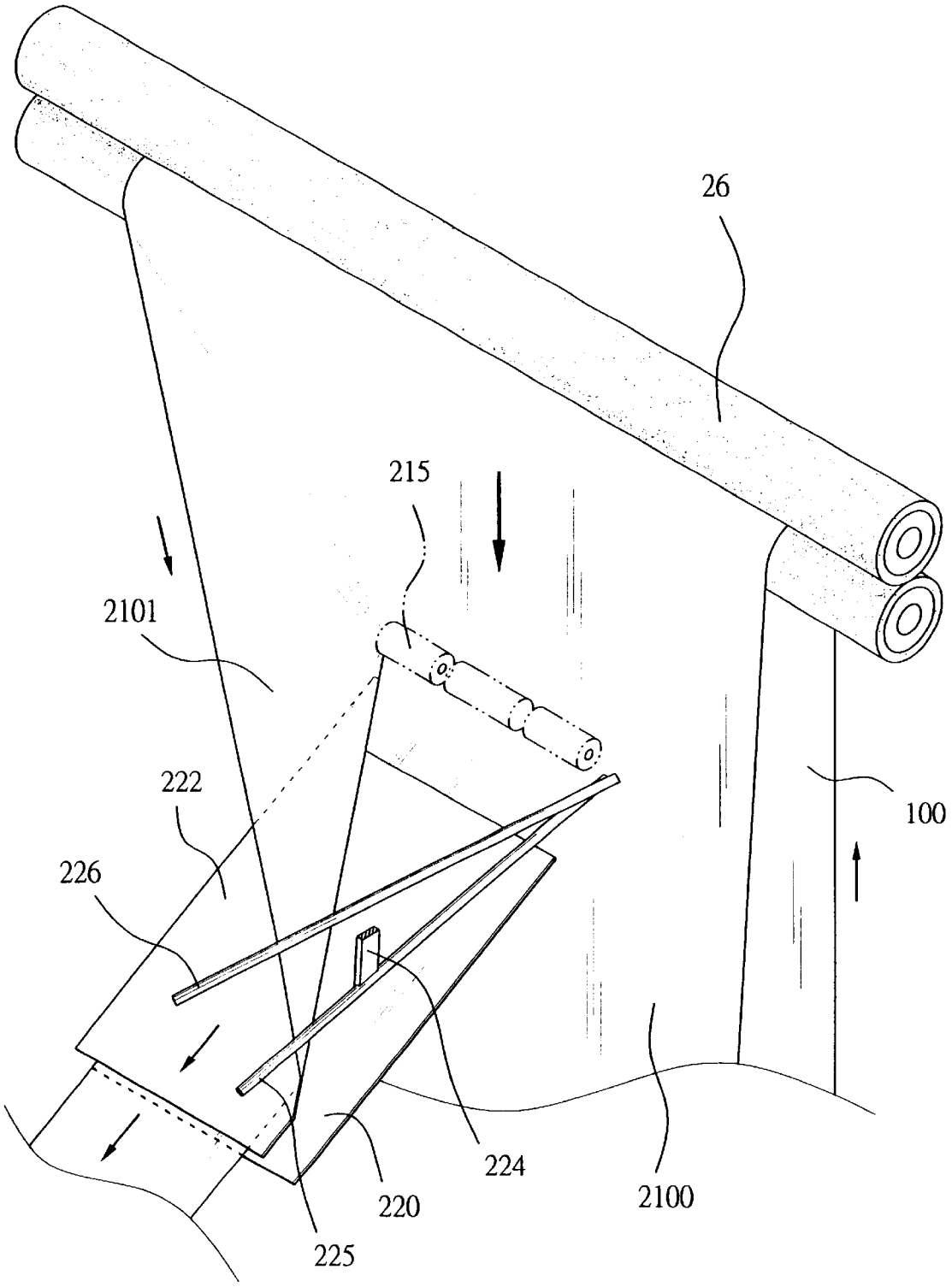
FIG. 5 is a schematic view of the folding device of the seal cutter for a plastic bag as shown in FIG. 2.
Figure 6:
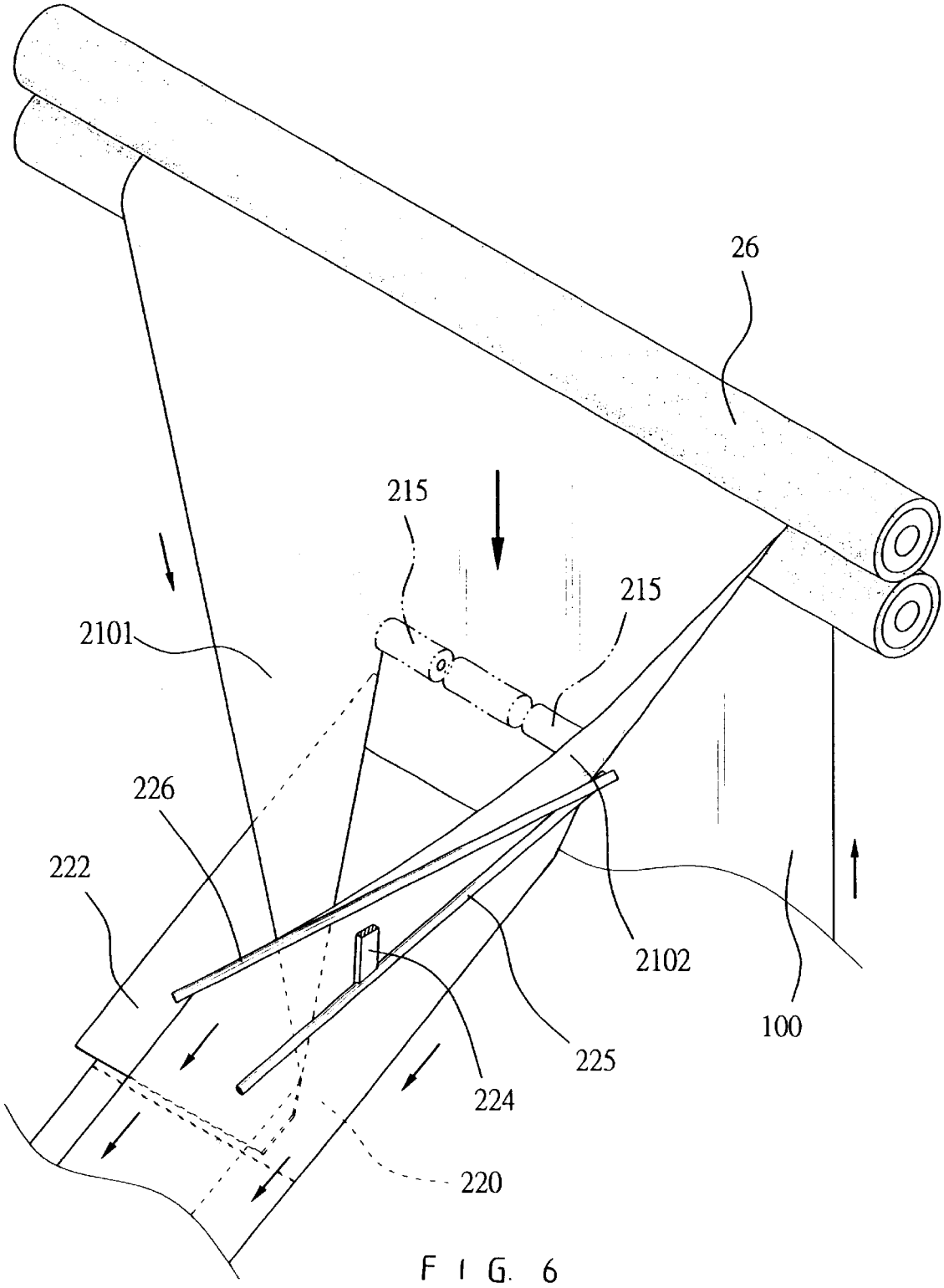
FIG. 6 is a schematic operational view of the folding device of the seal cutter for a plastic bag as shown in FIG. 2.
Figure 7:
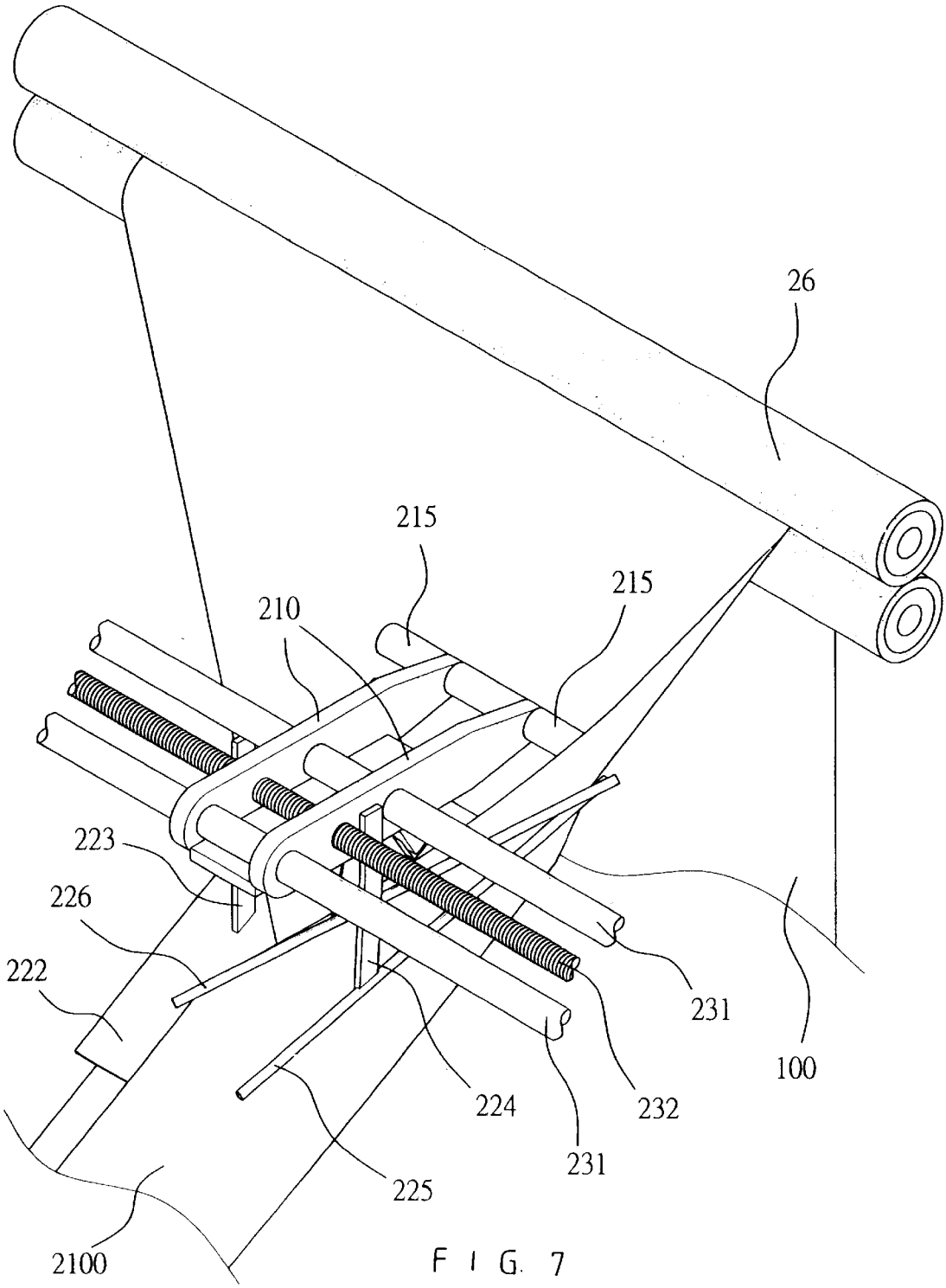
FIG. 7 is a schematic operational view of the folding device of the seal cutter for a plastic bag as shown in FIG. 2.

Referring to FIG. 5, when the plastic bag 100 is conveyed by the two conveyor rollers 26 to the fixing seat 29, one third of the width of the plastic bag 100 is limited by the rollers 215 at the top end of the fixing racks 210, and is guided by the rectangular guide plate 220. One side of the plastic bag 100 is guided by the oblique angle of the top end of the triangular guide plate 222, and is turned and folded through 180 degrees, thereby forming a first folding side 2101. The other side of the plastic bag 100 is guided by the drive rod 226, and is turned and folded through 180 degrees, thereby forming a second folding side 21012 as shown in FIG. 6. Thus, when the plastic bag 100 leaves the fixing seat 29, the plastic bag 100 is formed with a three-folding-layer shape as shown in FIG. 7. In addition, the rotation handle 233 mounted on one end of the threaded rod 232 may be used to rotate the threaded rod 232, so as to adjust the position of the fixing seat 29, thereby achieving the required folding position.

Figure 8:
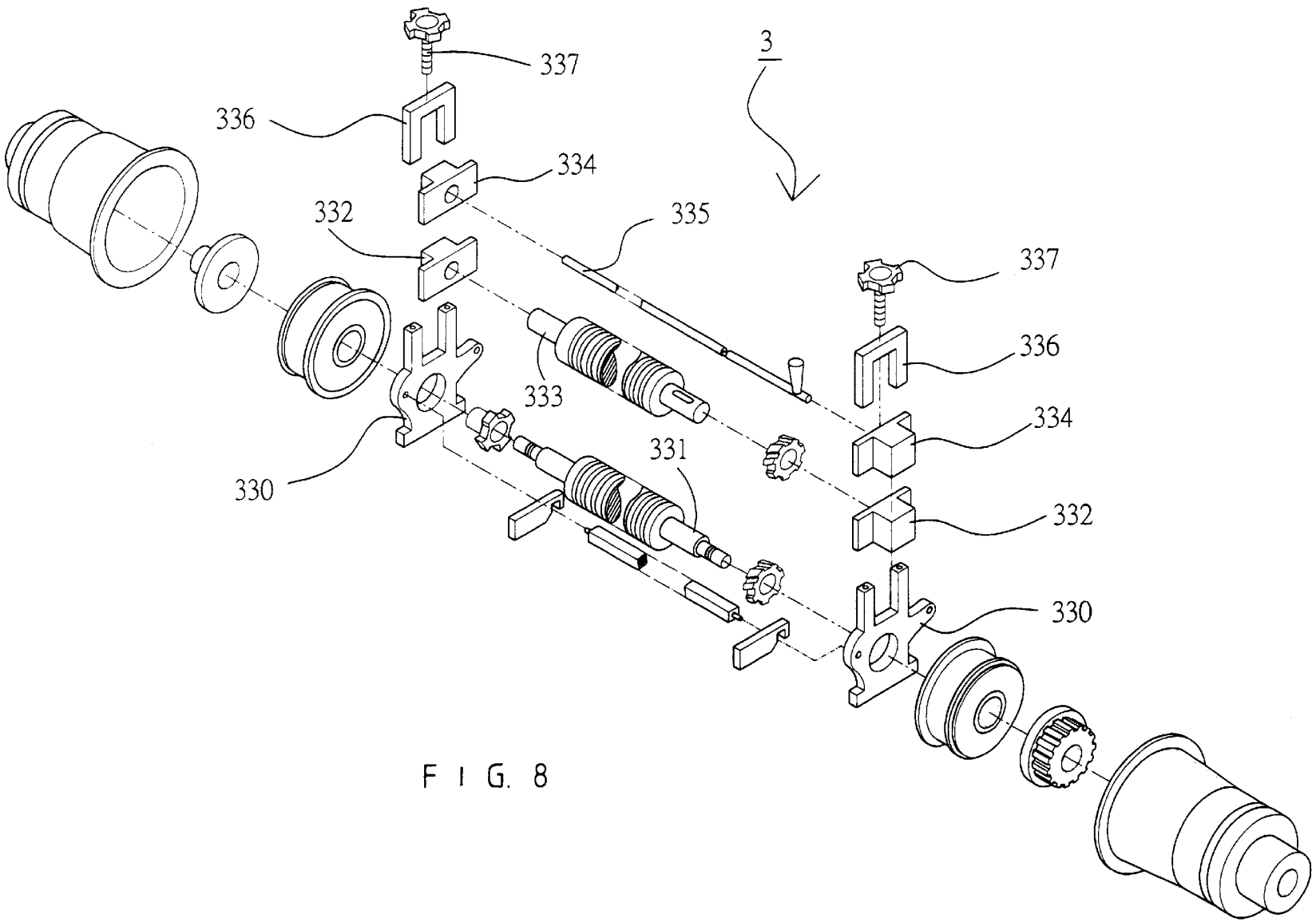
FIG. 8 is an exploded perspective view of a conveyor device of the seal cutter for a plastic bag in accordance with the preferred embodiment of the present invention.

Referring to FIG. 8, the conveyor device 3 includes two opposite U-shaped seats 330 for securing a drive rubber wheel 331, two opposite slide blocks 332 co-operating springs (not shown) for securing a driven rubber wheel 333, two opposite slide blocks 334 for securing an eccentric shaft 335 which has an eccentric wheel, two cover plates 336 for securing the slide blocks 334 and 332 on the U-shaped seat 330, and two adjusting knobs 337 each extended through the cover plate 336 to adjust the tension between the slide blocks 334 and 332. In addition, the slide blocks 334 and 332 are driven by a link (not shown).

Figure 9:
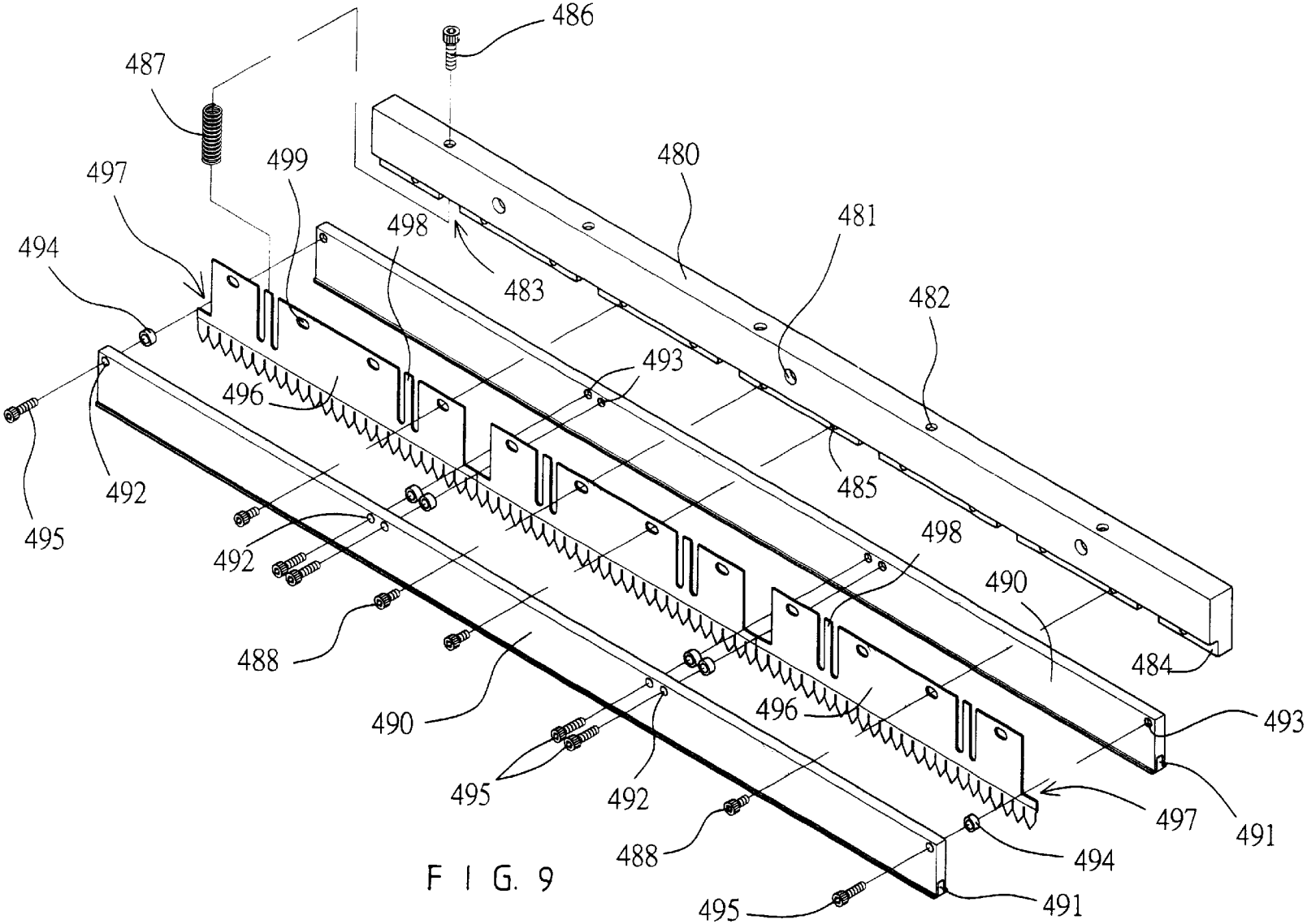
FIG. 9 is an exploded perspective view of a point cut-off device of the seal cutter for a plastic bag in accordance with the preferred embodiment of the present invention.
Figure 10A:
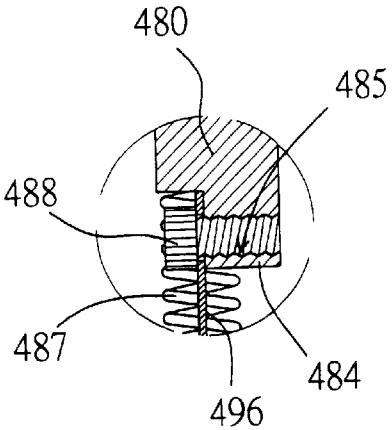
FIG. 10A is a partially cut-away side plan cross-sectional view of the point cut-off device of the seal cutter for a plastic bag as shown in FIG. 10.
Figure 10:
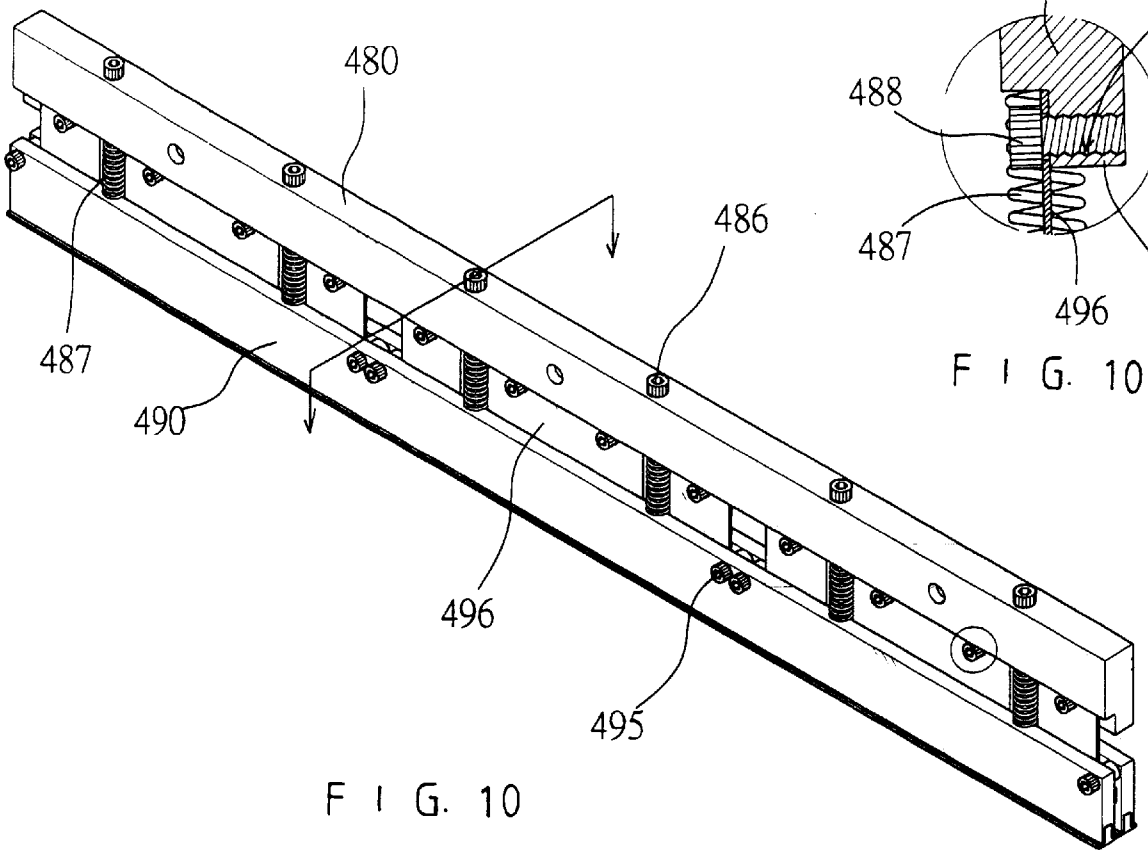
FIG. 10 is a perspective view of the point cut-off device of the seal cutter for a plastic bag as shown in FIG. 9.

Referring to FIGS. 9 and 10, the point cut-off device 4 includes a blade seat 480, a point cut-off blade 496, and two press plates 490.

The blade seat 480 has one side formed with multiple through holes 481, a top end formed with multiple screw bores 482, a bottom end formed with multiple spring support seats 483 and provided with a protruding fixing step 484. The fixing step 484 has one side formed with multiple screw bores 485.

The point cut-off blade 496 has a top formed with multiple through holes 499 aligning with the multiple screw bores 485 of the fixing step 484 of the blade seat 480. The point cut-off blade 496 is formed with multiple recesses facing upward, thereby forming multiple step portions 497. The point cut-off blade 496 is formed with multiple slots 498 aligning with the multiple spring support seats 483 of the blade seat 480 for mounting multiple springs 487.

Each of the two press plates 490 has a bottom provided with a press bar 491. One of the two press plates 490 has a top formed with multiple through holes 492 aligning with the multiple step portions 497 of the point cut-off blade 496, and the other press plate 490 has a top formed with multiple screw bores 493 aligning with the multiple step portions 497 of the point cut-off blade 496.

Figure 11:
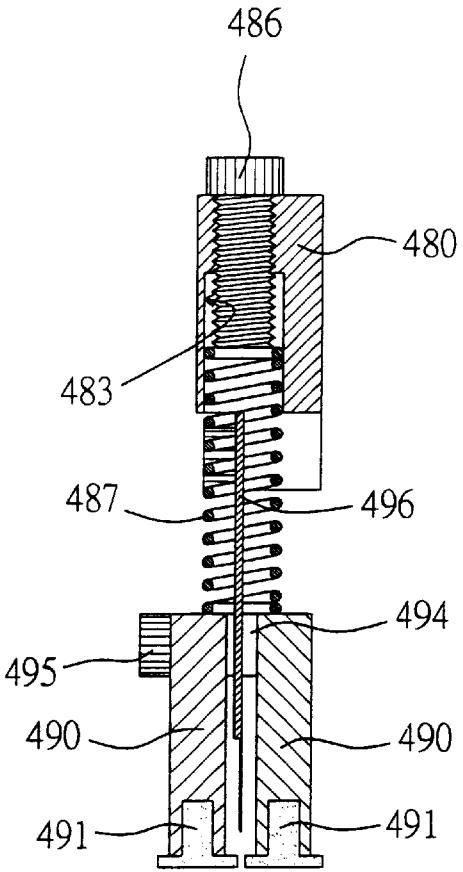
FIG. 11 is a side plan cross-sectional view of the point cut-off device of the seal cutter for a plastic bag as shown in FIG. 10.

In assembly, the point cut-off blade 496 is secured on the fixing step 484 of the blade seat 480 by multiple screws 488 which in turn extend through the multiple through holes 499 of the point cut-off blade 496 and the multiple screw bores 485 of the fixing step 484 of the blade seat 480 as shown in FIG. 10A. Each of the springs 487 is mounted in each of the slots 498 of the point cut-off blade 496, and is mounted in each of the multiple spring support seats 483 of the blade seat 480. The point cut-off device 4 further includes multiple screws 486 each screwed into each of the screw bores 482 of the blade seat 480 and each urged on the top of each of the springs 487 as shown in FIG. 11.

Each of the two press plate 490 is mounted on the point cut-off blade 496 by multiple screws 495 which in turn extend through the multiple through holes 492 of one press plate 490 and multiple sleeves 494, and are screwed into the screw bores 493 of the other press plate 490. The multiple sleeves 494 are rested on the multiple step portions 497 of the point cut-off blade 496. The bottom of each of the springs 487 is rested on the top end of each of the two press plate 490.

Figure 12:
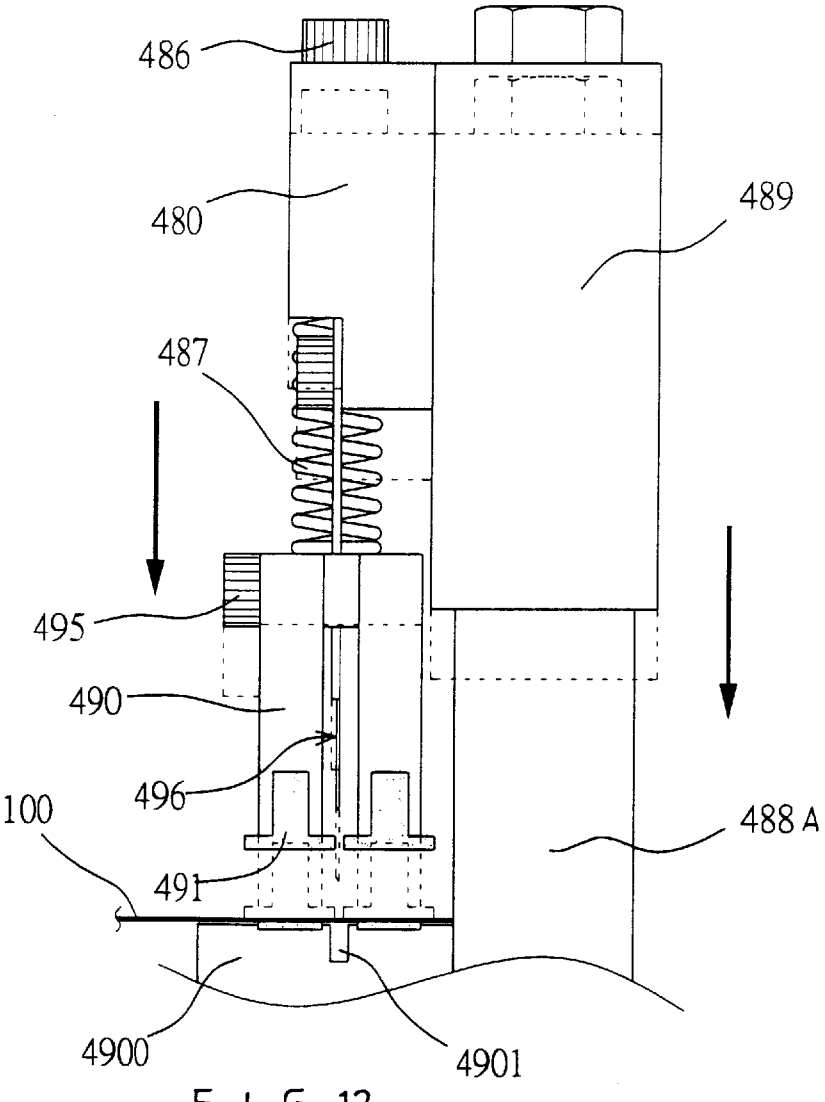
FIG. 12 is a schematic side plan view of the point cut-off device of the seal cutter for a plastic bag as shown in FIG. 10.

Referring to FIG. 12, the blade seat 480 is secured on a drive seat 489 between two opposite drive bars 488A of the seal cutter 1 by multiple screws which are extended through the through holes 481 of the blade seat 480, and are screwed into the drive seat 489. Thus, when the drive seat 489 is lifted, the two press plates 490 are pushed by the springs 487, so that the point cut-off blade 496 is received between the two press plates 490. At the same time, the multiple step portions 497 of the point cut-off blade 496 are retained by the sleeves 494 between the two press plates 490, so that the point cut-off blade 496 is retained between the two press plates 490.

Figure 13:
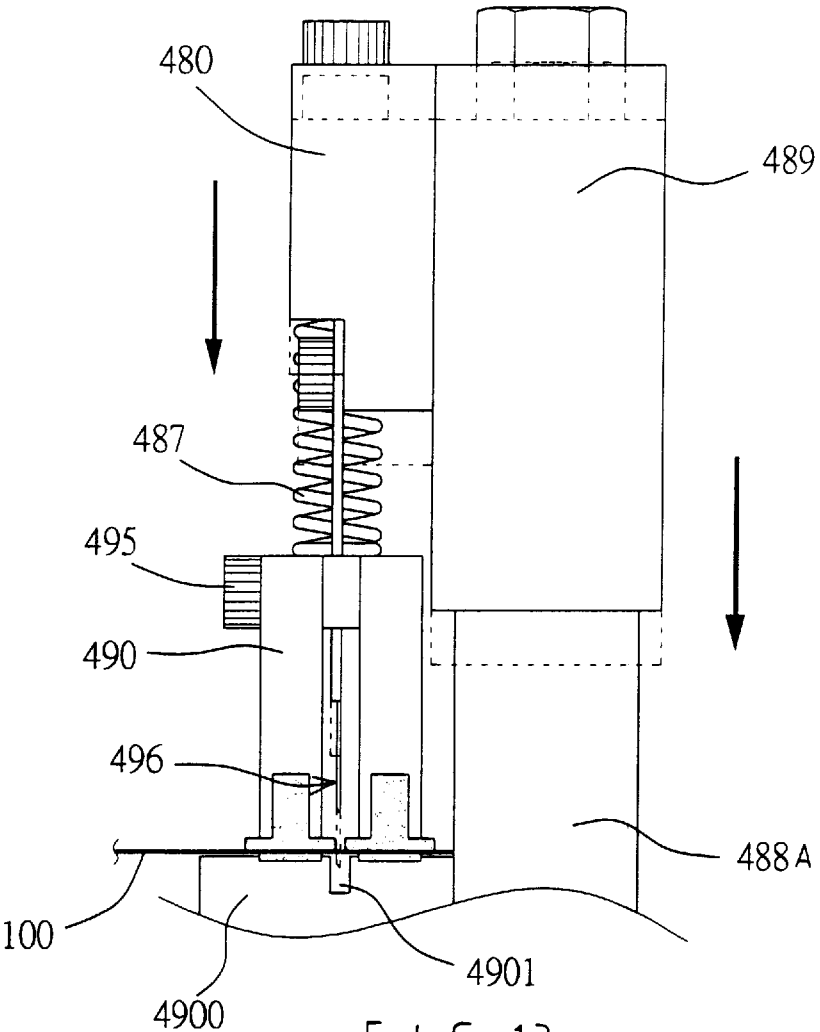
FIG. 13 is a schematic operational view of the point cut-off device of the seal cutter for a plastic bag as shown in FIG. 12.
Figure 14:
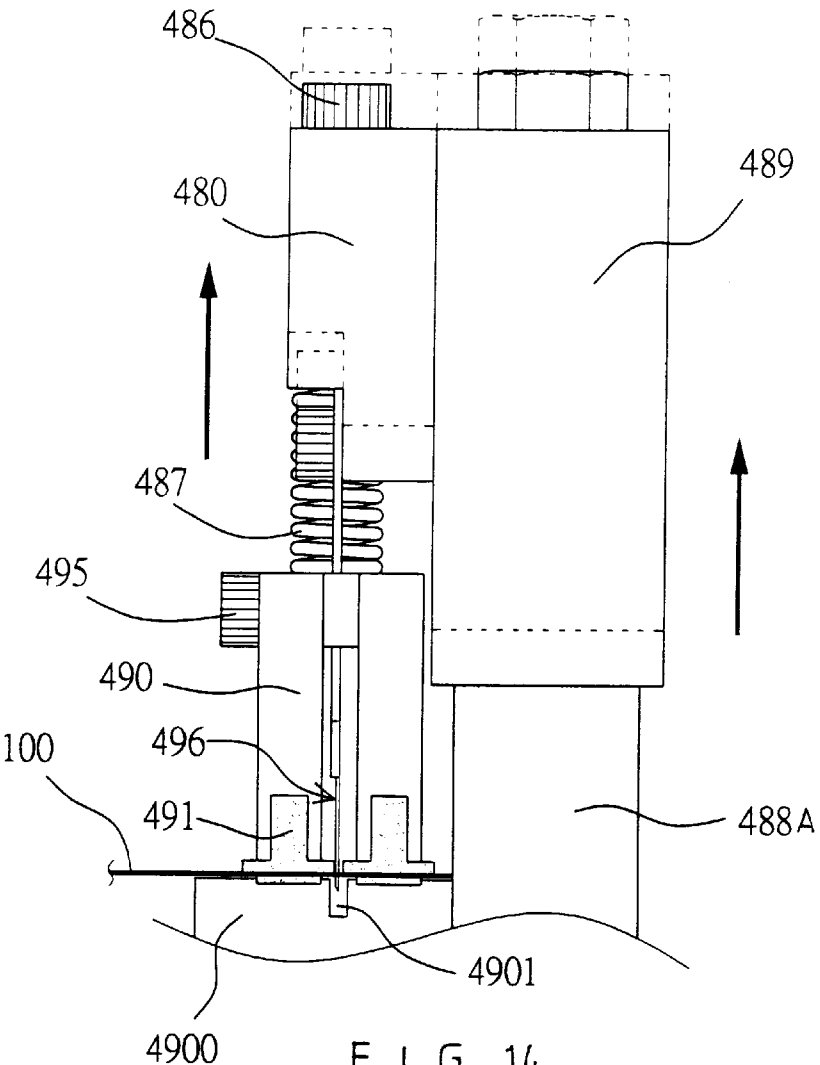
FIG. 14 is a schematic operational view of the point cut-off device of the seal cutter for a plastic bag as shown in FIG. 13.

Referring to FIG. 13, when the drive seat 489 is lowered, the two press plates 490 and the drive seat 489 are moved downward until the two press plates 490 press the plastic bag 100 on the lower mold seat 4900. When the drive seat 489 is lowered continuously, the two press plates 490 are stopped by the lower mold seat 4900, and the point cut-off blade 496 is continuously moved downward by the drive seat 489 into a lower mold recess 4901 as shown in FIG. 14, so that the point cut-off blade 496 may point cut-off the plastic bag 100 in a flush manner. At the same time, the springs 487 are compressed between the two press plates 490 and the blade seat 480 as shown in FIG. 14, so that the plastic bag 100 may be pressed by the two press plates 490 tightly. The screws 486 mounted on the blade seat 480 may be used to adjust the tension of the springs 487, so as to adjust the point cut-off effect of the point cut-off blade 496.

Figure 15:
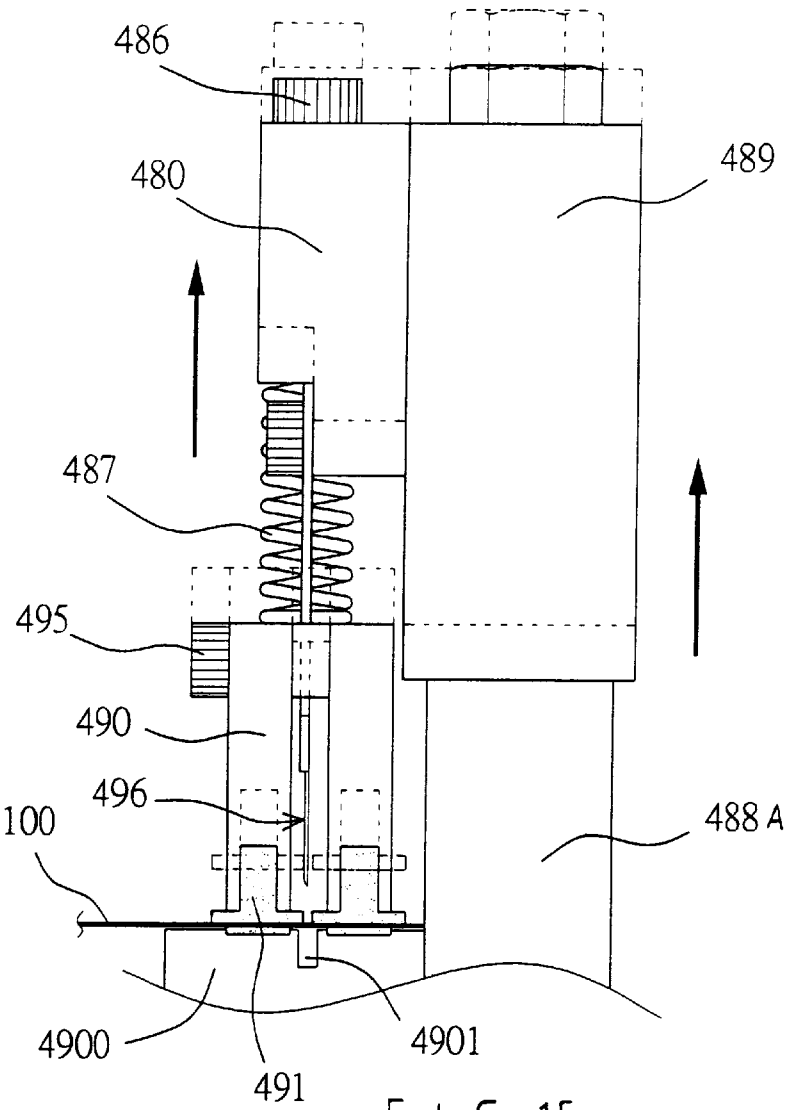
FIG. 15 is a schematic operational view of the point cut-off device of the seal cutter for a plastic bag as shown in FIG. 14.

Referring to FIG. 15, when the drive seat 489 is lifted, the point cut-off blade 496 is moved upward with the drive seat 489 to detach from the plastic bag 100, while the two press plates 490 are still pushed by the springs 487 to press the plastic bag 100. When the multiple step portions 497 of the point cut-off blade 496 are in contact with the sleeves 494 between the two press plates 490, the two press plates 490 may be lifted by the point cut-off blade 496 to the original position as shown in FIG. 12.

Figure 16:
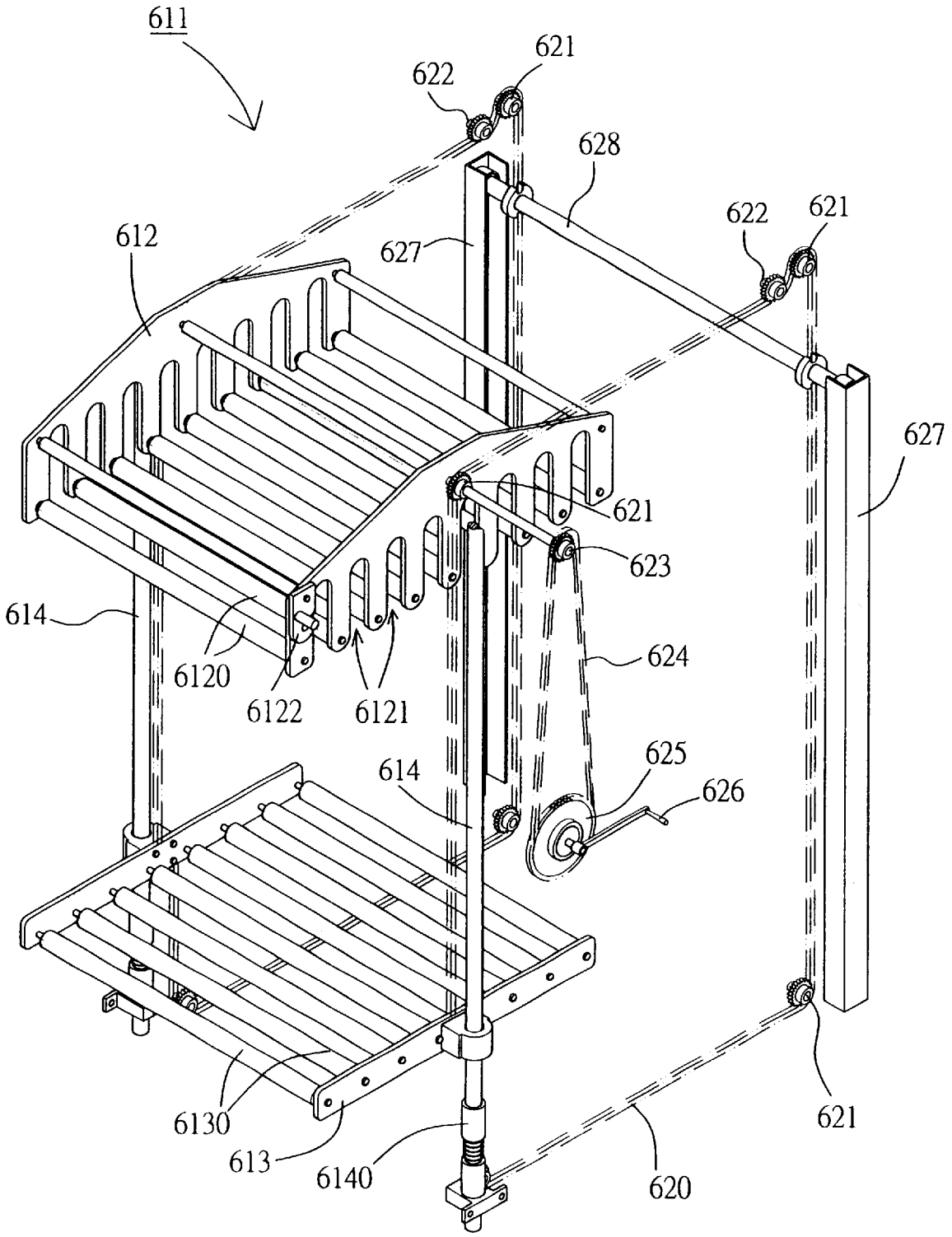
FIG. 16 is a perspective view of a tension control device of the seal cutter for a plastic bag in accordance with the preferred embodiment of the present invention.
Figure 17:
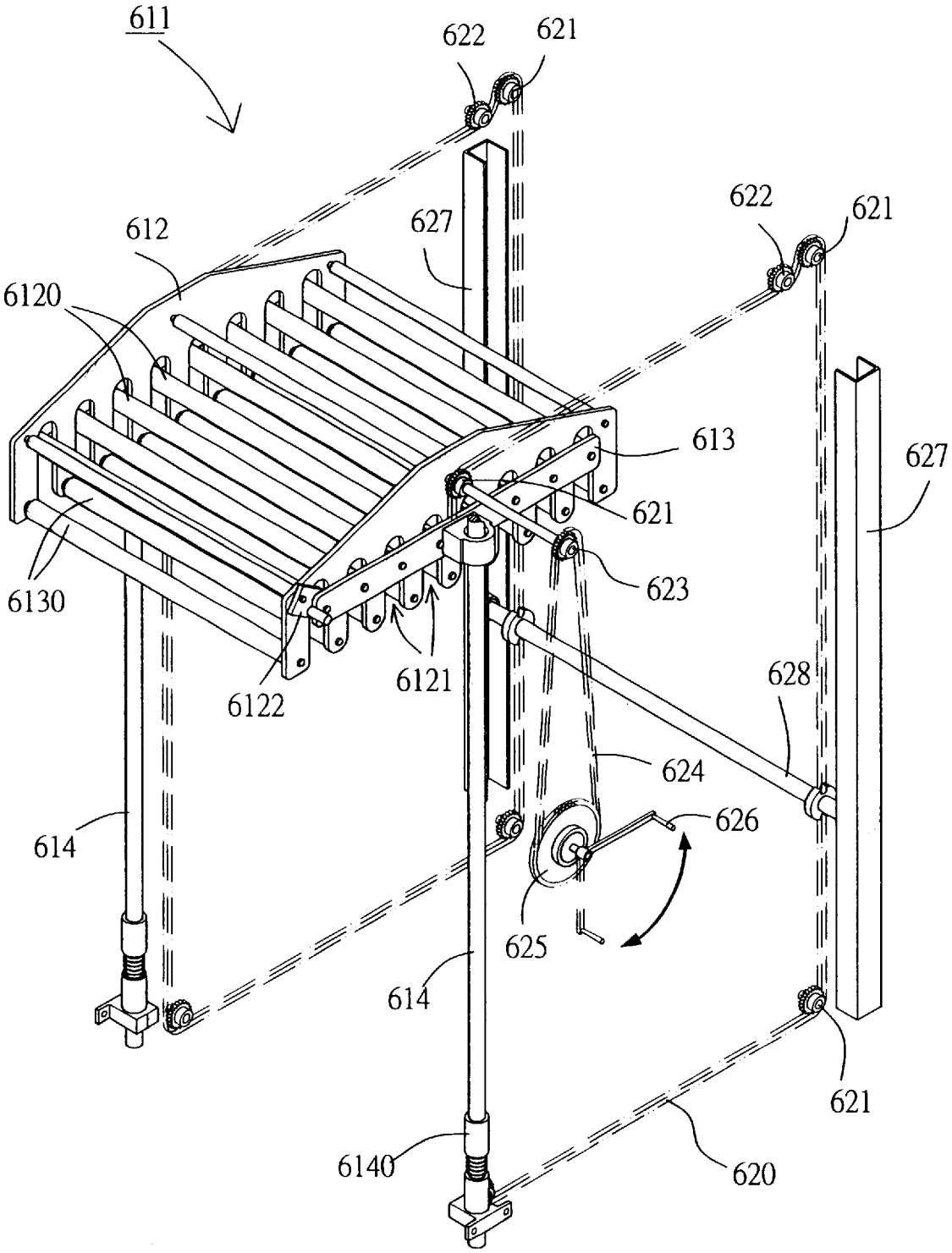
FIG. 17 is an operational view of the tension control device of the seal cutter for a plastic bag as shown in FIG. 16.

Referring to FIGS. 16 and 17, the tension control device 611 includes a fixed roller set 612, a movable roller set 613, and a chain set 620.

The fixed roller set 612 includes two opposite fixed plates, and multiple rollers 6120 mounted between the two fixed plates. Each of the two fixed plates of the fixed roller set 612 is formed with multiple slots 6121 each located between any two adjacent rollers 6120. Each of the two fixed plates of the fixed roller set 612 has a front end pivoted with a hanging hook 6122.

The movable roller set 613 includes two opposite fixed plates, and multiple rollers 6130 mounted between the two fixed plates. Each of the two fixed plates of the movable roller set 613 is slidably mounted on one of two guide rods 614. Each of the two guide rods 614 has a bottom provided with a buffer device 6140.

The chain set 620 is mounted on each of the two sides of the fixed roller set 612 and the movable roller set 613, and includes multiple sprockets 621 mounted on four corners, a chain mounted on the multiple sprockets 621 and having two ends respectively secured on each of the two fixed plates of the movable roller set 613, and at least one tension sprocket 622 mounted beside one of the sprocket 621 for adjusting the tension of the chain of the chain set 620. In addition, the chain set 620 further includes a sprocket 623 secured on a fixed shaft of one of the sprockets 621, a chain 624 mounted on the sprocket 23, a sprocket 625 mounted on the chain 624, and a rotation handle 626 mounted on the sprocket 625 for rotating the sprocket 625.

In operation, the rotation handle 626 may be used for rotating the sprocket 625 to rotate the sprocket 623 by the chain 624, thereby rotating the sprocket 621, so as to move the chain set 620, so that the movable roller set 613 may be lifted by guidance of the guide rods 614. Thus, the rollers 6130 of the movable roller set 613 may be inserted into the slots 6121 between the rollers 6120 of the fixed roller set 612, and the rollers 6130 of the movable roller set 613 are located above the rollers 6120 of the fixed roller set 612. The movable roller set 613 will not fall down by hooking of the hanging hook 6122. Thus, the plastic bag 100 may be passed between the rollers 6130 of the movable roller set 613 and the rollers 6120 of the fixed roller set 612, and may be guided by multiple rollers of a winder into the coreless winding device 7. Then, the hanging hook 6122 may be released, so that the movable roller set 613 may be lowered, and the rollers 6130 of the movable roller set 613 may pull the plastic bag 100 downward. Thus, the rollers 6130 of the movable roller set 613 and the rollers 6120 of the fixed roller set 612 may co-operate to pull the plastic bag 100 to maintain a predetermined tension for being wound into a scroll. In addition, the chain set 620 further includes two guide rails 627, and a connecting rod 628 mounted between the two guide rails 627 for connecting the chains of the chain set 620.

Figure 18:
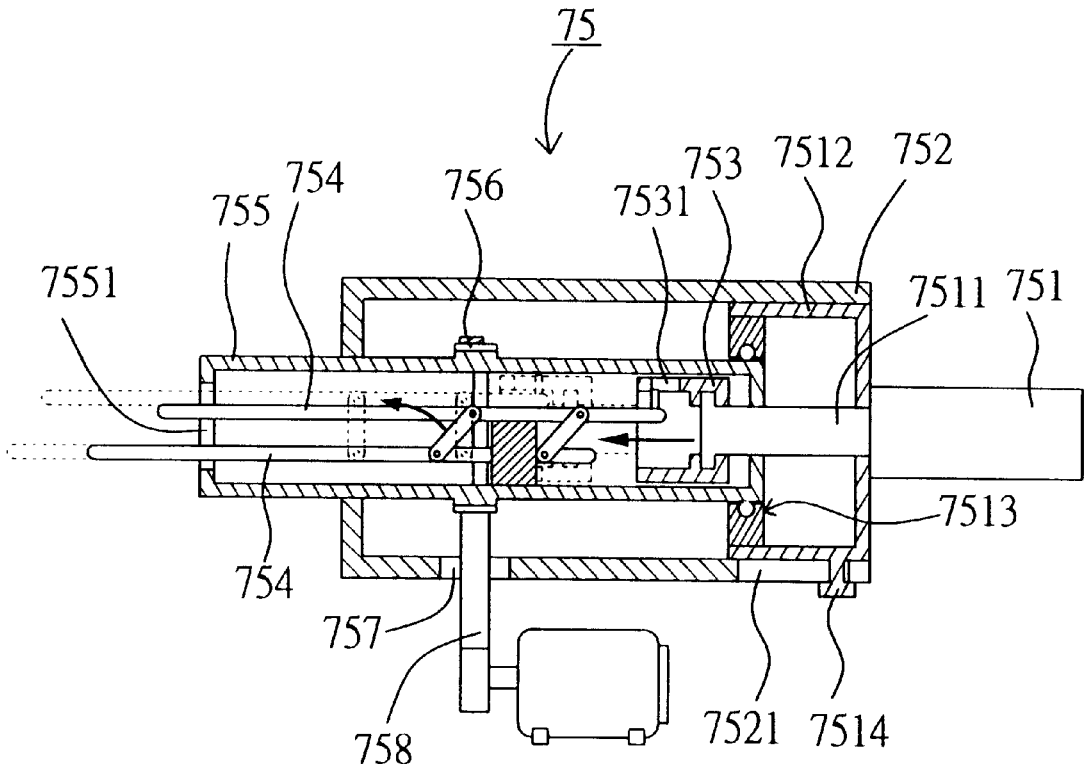
FIG. 18 is a side plan cross-sectional view of a piston rod structure of a coreless winding device of the seal cutter for a plastic bag in accordance with the preferred embodiment of the present invention.
Figure 19:
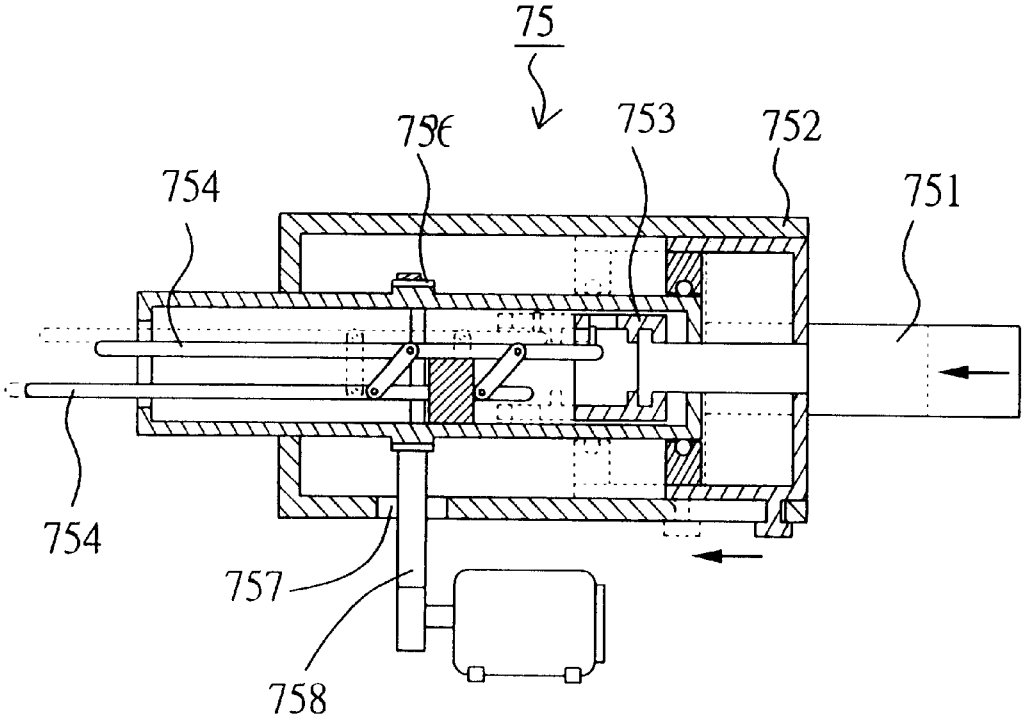
FIG. 19 is an operational view of the piston rod structure of the coreless winding device of the seal cutter for a plastic bag as shown in FIG. 18.

Referring to FIGS. 18 and 19, the coreless winding device 7 includes a piston rod structure 75 including an outer tube 752, and a gas pressure cylinder 751 mounted on a rear end of the outer tube 752. The gas pressure cylinder 751 has a front end secured with a bearing disk 7512. The bearing disk 7512 is provided with a locking screw 7514 protruding outward from an oblong hole 7521 formed in the outer tube 752. The gas pressure cylinder 751 has a gas pressure rod 7511 extended into the outer tube 752 through a bearing hole 7513 in the bearing disk 7512, and pivotally connected with a first end of a sleeve 753 which has a second end formed with an elongated through hole 7531. The piston rod structure 75 of the coreless winding device 7 further includes an inner tube 755 mounted in the bearing hole 7513 and the outer tube 752 for receiving the gas pressure rod 7511, two opposite piston rods 754 mounted in the inner tube 755 and protruding outward from an elongated through hole 7551 formed in the inner tube 755. One of the two piston rods 754 is fixed, and the other piston rod 754 is movable. The two opposite piston rods 754 are pivotally connected by pivot plates. The movable piston rod 754 has a distal end received in the elongated through hole 7531 of the sleeve 753. The inner tube 755 has an outer wall provided with a gear 756. The outer tube 752 has a wall formed with a through hole 757 for passage of a drive belt 758 which meshes with the gear 756.

Figure 20A:
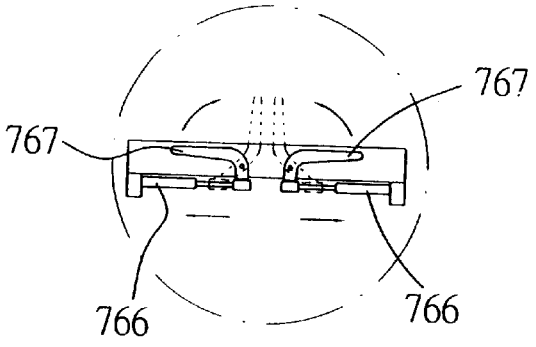
FIG. 20A is a partially cut-away plan view of the clamping structure of the coreless winding device of the seal cutter for a plastic bag as shown in FIG. 18.
Figure 20:
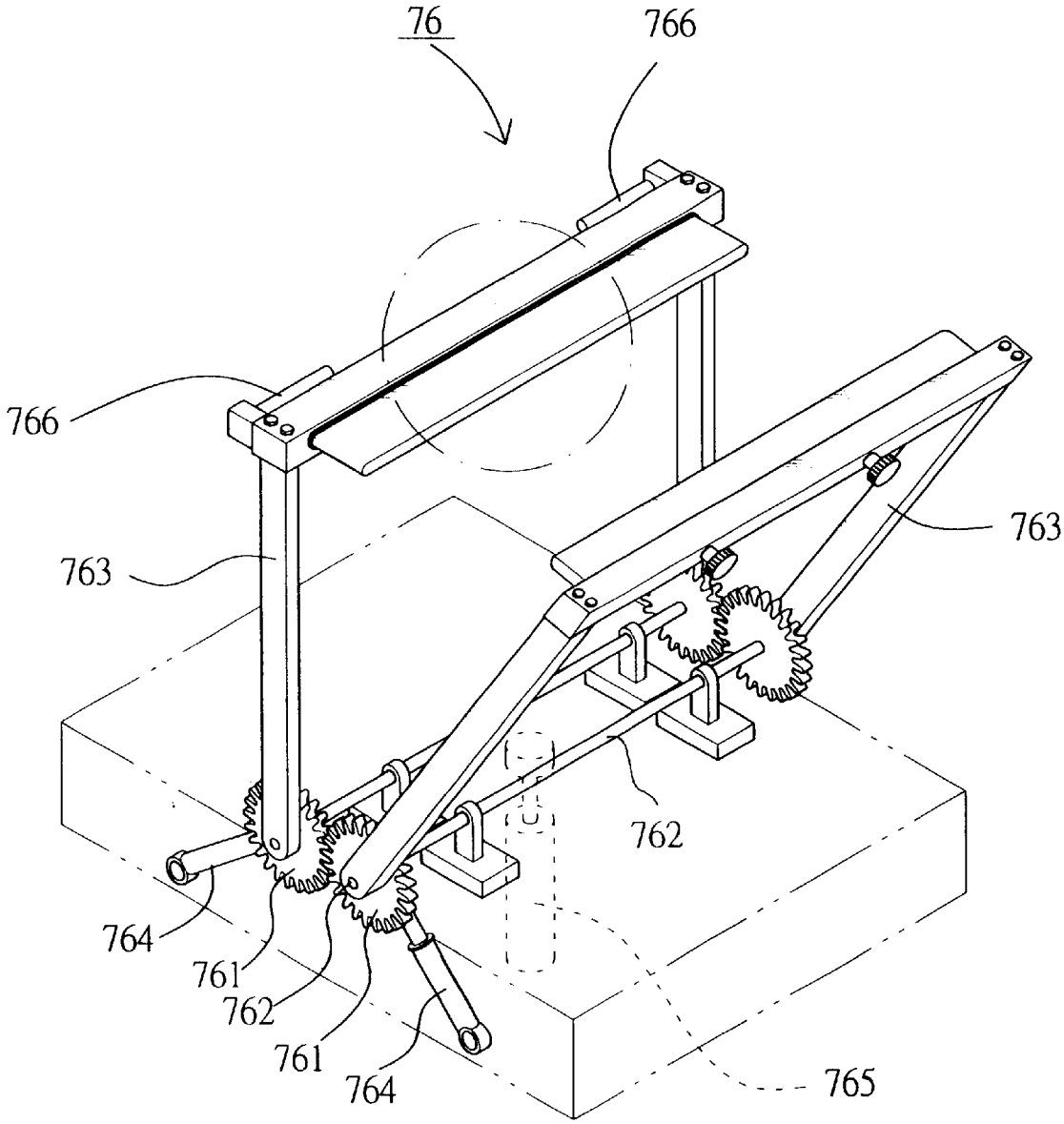
FIG. 20 is a perspective view of a clamping structure of the coreless winding device of the seal cutter for a plastic bag in accordance with the preferred embodiment of the present invention.

Referring to FIG. 20, the coreless winding device 7 further includes a clamping structure 76 including two shafts 762 each mounted on a support base and each having two ends each provided with a gear 761, two inverted U-shaped clips 763 each mounted on one of the two shafts 761, two gas pressure cylinders 764 each pivotally mounted on the support base and each pivotally mounted on the gear 761 of one of the two shafts 761, and a gas pressure cylinder 765 mounted on a bottom of the support base for lifting the support base. One of the two inverted U-shaped clips 763 is provided with two opposite small gas pressure cylinders 766 each having a gas pressure rod for driving a drive bar 767 (see FIG. 20A) pivotally mounted on a side portion to rotate relatively.

Figure 21:
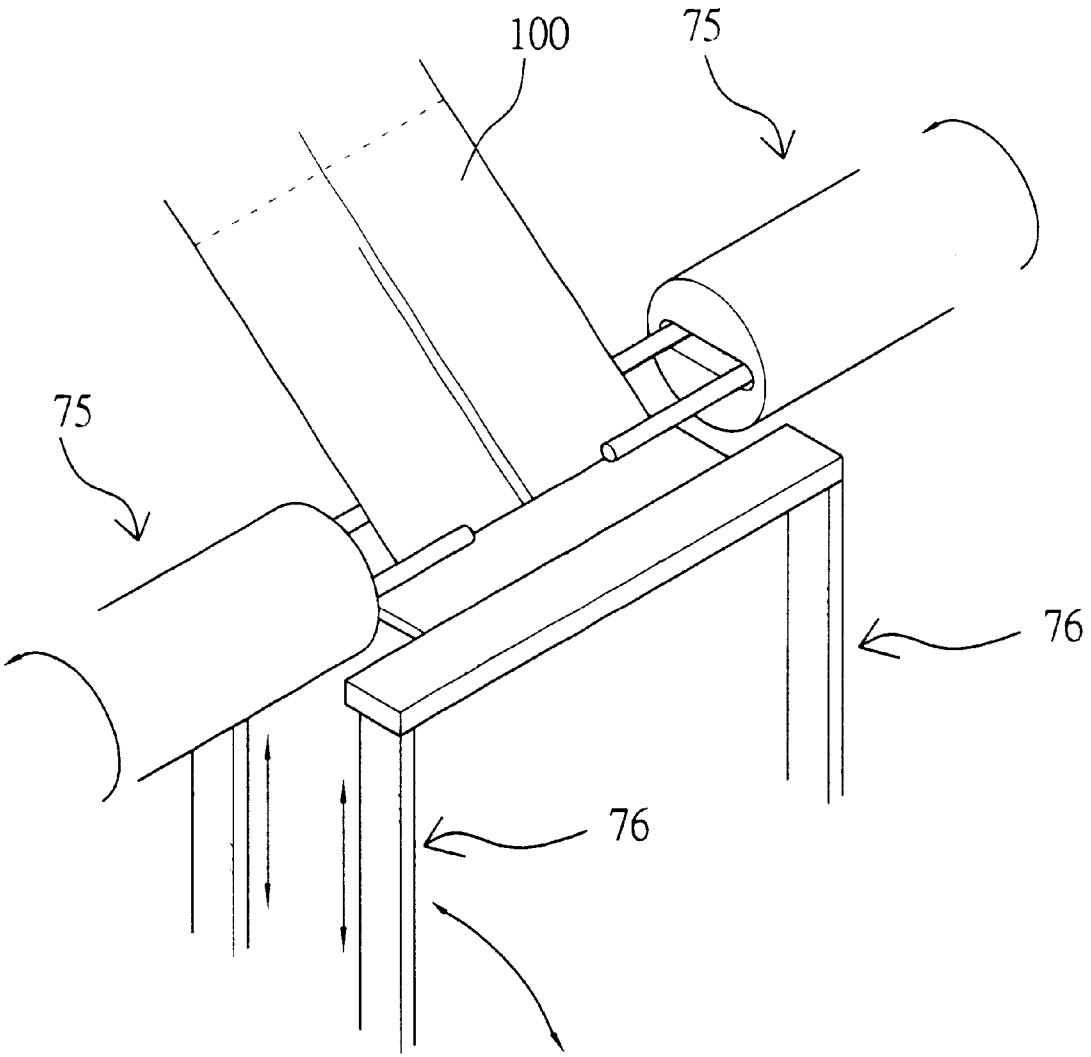
FIG. 21 is a schematic operational view of the coreless winding device of the seal cutter for a plastic bag in accordance with the preferred embodiment of the present invention.

Referring to FIG. 21, the piston rods 754 of the piston rod structure 75 may be moved reciprocally by the gas pressure cylinder 751. When the gas pressure cylinder 751 is retracted, the movable piston rod 754 may be pulled by the gas pressure cylinder 751 through the sleeve 753, so that the movable piston rod 754 may be moved toward the fixed piston rod 754, thereby forming a closed state. In addition, a gap is defined between the movable piston rod 754 and the fixed piston rod 754. When the gas pressure cylinder 751 is pushed forward, the two piston rods 754 are juxtaposed, thereby forming an opened state. When the gear 756 in the inner tube 755 is driven by the drive belt 758, the two piston rods 754 may be rotated by limit of the elongated through hole 7551 of the inner tube 755, and mounting of the sleeve 753 may maintain the fixed state of the gas pressure cylinder 751. In addition, when the locking screw 7514 of the bearing disk 7512 is unscrewed from the oblong hole 7521 of the outer tube 752, the bearing disk 7512 may be pushed to drive the gas pressure cylinder 751 to move relative to the outer tube 752, thereby changing and adjusting the distance between the two sets of opposite piston rod structures 75, so as to fit the width of the plastic bag 100. Further, the two gas pressure cylinders 764 of the clamping structure 76 may be moved to rotate the two gears 761, so that the two inverted U-shaped clips 763 may be pivoted to perform the clamping and releasing actions.

Accordingly, the plastic bag may be formed with a three-folding-layer shape by the folding device 2. Then, the rotation handle 626 may be used for rotating the sprocket 625 to rotate the sprocket 623 by the chain 624, thereby rotating the sprocket 621, so as to move the chain set 620, so that the movable roller set 613 may be lifted by guidance of the guide rods 614, and the rollers 6130 of the movable roller set 613 may be located above the rollers 6120 of the fixed roller set 612, thereby facilitating passage of the plastic bag 100.

In addition, the plastic bag 100 in the tension control zone is pulled by the clamping structure 76 to move downward to the lower portion of the piston rod structure 75, so that the two piston rods 754 of the piston rod structure 75 mounted on each of the two sides of the seal cutter 1 may be protruded outward with the plastic bag 100 being located between the two piston rods 754 of the piston rod structure 75. Then, the two piston rods 754 of the piston rod structure 75 may be rotated by the inner tube 755 driven by a motor, so as to wind the plastic bag 100. After the plastic bag 100 has been wound, rotation of the two piston rods 754 of the piston rod structure 75 may be stopped by the motor, and the plastic bag 100 may be clamped by the clamping structure 76. The two drive bars 767 may be driven by the two opposite small gas pressure cylinders 766 to clamp the point cut-off positions of the plastic bag 100, thereby separating the plastic bag 100.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A seal cutter for a plastic bag, comprising a folding device, a conveyor device, a point cut-off device, a tension control device, and a coreless winding device, wherein:

the folding device includes a fixing seat including two opposite fixing racks which are combined with each other by a fixing plate and a roller, a first connecting plate is secured on a bottom of the fixing plate, a rectangular guide plate is mounted on the first connecting plate in an inclined manner, and is provided with a protruding block secured on the first connecting plate, a triangular guide plate is provided with a link secured on one of the two opposite fixing racks, so that the triangular guide plate is rested on the rectangular guide plate, a second connecting plate is secured on the other one of the two opposite fixing racks, a fixing rod is secured on a bottom of the second connecting plate, an oblique drive rod is secured on one end of the fixing rod, and is located above the triangular guide plate;

the conveyor device includes two opposite U-shaped seats for securing a drive rubber wheel, two opposite first slide blocks for securing a driven rubber wheel, two opposite second slide blocks for securing an eccentric shaft, two cover plates for securing the first and second slide blocks on the U-shaped seat, and two adjusting knobs each extended through a respective cover plate to adjust a tension between the first and second slide blocks;

the point cut-off device includes a blade seat, a point cut-off blade, and two press plates, the blade seat has a bottom end formed with multiple spring support seats, and has a top end formed with multiple screw bores, the point cut-off blade is formed with multiple slots aligning with the multiple spring support seats of the blade seat for mounting multiple springs, each of the springs has a top urged on a respective spring support seat of the blade seat and has a bottom urged on the two press plates, the point cut-off blade is formed with multiple step portions, each of the two press plates is mounted on the point cut-off blade by multiple screws which extend through the two press plates and through multiple sleeves between the two press plates, each of the multiple sleeves is rested on a respective step portion of the point cut-off blade;

the tension control device includes a fixed roller set, a movable roller set, and a chain set for moving the movable roller set to engage the fixed roller set;

the coreless winding device includes a piston rod structure, and a clamping structure, wherein:

the piston rod structure includes an outer tube, and a gas pressure cylinder mounted on a rear end of the outer tube, the gas pressure cylinder has a front end secured with a bearing disk, the gas pressure cylinder has a gas pressure rod extended into the outer tube through a bearing hole in the bearing disk, and pivotally connected with a first end of a sleeve which has a second end formed with an elongated through hole, an inner tube is mounted in the bearing hole and the outer tube for receiving the gas pressure rod, two opposite piston rods mounted in the inner tube and protruding outward from an elongated through hole formed in the inner tube, one of the two piston rods is fixed, and the other piston rod is movable; and the clamping structure including two shafts each mounted on a support base and each having two ends each provided with a gear, two inverted U-shaped clips each mounted on one of the two shafts, two gas pressure cylinders each pivotally mounted on the support base and each pivotally mounted on the gear of one of the two shafts, and a gas pressure cylinder mounted on a bottom of the support base for lifting the support base, one of the two inverted U-shaped clips is provided with two opposite small gas pressure cylinders each having a gas pressure rod for driving a drive bar pivotally mounted on a side portion to rotate relatively.

2. The seal cutter for a plastic bag in accordance with claim 1, wherein the folding device further includes two opposite upright frames, two opposite fixing brackets each secured on one of the two opposite upright frames, two opposite slide rods each mounted between the two opposite fixing brackets, a threaded rod mounted between the two opposite fixing brackets, and a rotation handle mounted on one end of the threaded rod for rotating the threaded rod, and each of the two opposite fixing racks is formed with a screw bore for passage of the threaded rod, and two through holes for passage of the two side rods.

3. The seal cutter for a plastic bag in accordance with claim 1, wherein the each of the two opposite fixing racks has one end provided with a bearing, and the bearing of each of the two opposite fixing racks is secured with a roller.

4. The seal cutter for a plastic bag in accordance with claim 1, wherein each of the two press plates has a bottom provided with a press bar.

5. The seal cutter for a plastic bag in accordance with claim 1, wherein the bottom of the blade seat is provided with a protruding fixing step.

6. The seal cutter for a plastic bag in accordance with claim 1, wherein the fixed roller set includes two opposite fixed plates, and multiple rollers mounted between the two fixed plates, each of the two fixed plates of the fixed roller set is formed with multiple slots each located between any two adjacent rollers, each of the two fixed plates of the fixed roller set has a front end pivoted with a hanging hook, the movable roller set includes two opposite fixed plates, and multiple rollers mounted between the two fixed plates, each of the two fixed plates of the movable roller set is slidably mounted on one of two guide rods, each of the two guide rods has a bottom provided with a buffer device, the chain set is mounted on each of the two sides of the fixed roller set and the movable roller set, and includes multiple sprockets mounted on four corners, a chain mounted on the multiple sprockets and having two ends respectively secured on each of the two fixed plates of the movable roller set, and at least one tension sprocket mounted beside one of the sprocket for adjusting the tension of the chain of the chain set, the chain set further includes a second sprocket secured on a fixed shaft of one of the sprockets, a second chain mounted on the second sprocket, a third sprocket mounted on the second chain, and a rotation handle mounted on the third sprocket for rotating the third sprocket.

7. The seal cutter for a plastic bag in accordance with claim 6, wherein the chain set further includes two guide rails, and a connecting rod mounted between the two guide rails for connecting the chains of the chain set.

8. The seal cutter for a plastic bag in accordance with claim 1, wherein the bearing disk is provided with a locking screw protruding outward from an oblong hole formed in the outer tube.

9. The seal cutter for a plastic bag in accordance with claim 1, wherein the movable piston rod has a distal end received in the elongated through hole of the sleeve.

10. The seal cutter for a plastic bag in accordance with claim 1, wherein the inner tube has an outer wall provided with a gear, and the outer tube has a wall formed with a through hole for passage of a drive belt which meshes with the gear.

* * * * *